US007596982B1

(12) United States Patent
Clark

(10) Patent No.: US 7,596,982 B1
(45) Date of Patent: Oct. 6, 2009

(54) APPARATUS AND METHOD FOR REPAIRING A WHEEL BEARING CAGE

(75) Inventor: Jeffery J. Clark, Tempe, AZ (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 12/216,315

(22) Filed: Jul. 2, 2008

(51) Int. Cl.
*B21D 31/00* (2006.01)
*H01R 43/042* (2006.01)

(52) U.S. Cl. ..... 72/409.1; 72/309; 72/314; 72/321; 72/389.2; 72/409.12; 72/459; 72/460; 81/355

(58) Field of Classification Search ..... 72/304–323, 72/389.1, 389.2, 409.01, 409.12, 457, 458, 72/459, 460, 479; 81/355, 356
See application file for complete search history.

(56) References Cited

U.S. PATENT DOCUMENTS 2,800,042 A * 7/1957 Demler ..... 72/409.08
3,029,670 A * 4/1962 Over et al. ..... 72/451
3,747,392 A * 7/1973 King et al. ..... 72/409.13
3,800,387 A 4/1974 Hamilton
3,977,230 A 8/1976 Jones
4,050,271 A 9/1977 Jones
4,488,425 A * 12/1984 Meikle ..... 72/389.2
4,559,805 A * 12/1985 McClure ..... 72/384
5,222,386 A * 6/1993 Jones, Jr. ..... 72/319
5,435,167 A * 7/1995 Holliday et al. ..... 72/409.14
6,314,843 B1 * 11/2001 Wiebe et al. ..... 81/355
2003/0097869 A1 5/2003 Meichtry
2007/0056349 A1 3/2007 Knowles

* cited by examiner

*Primary Examiner*—David B Jones
(74) *Attorney, Agent, or Firm*—Birch, Stewart, Kolasch & Birch, LLP

(57) ABSTRACT

An apparatus (100) or repairing dented bearing cages (50) comprises: a first contact surface (122) for contacting an outer diameter of the bearing cage (50); a second contact surface (126) for contacting an inner diameter of the bearing cage (50); a first handle (102); a second handle (104) operatively connected to the first handle (102) via a pivot mechanism (106); a retraction element (108) connected to the second contact surface (126); and an adjustment mechanism (116). The retraction element (108) retracts upon movement of the second handle (104) relative to the first handle (102) to move the second contact surface (126) towards the first contact surface (122) so as to impart a force against a dented region of the bearing cage (50) located between the second contact surface (126) and the first contact surface (122). The adjustment mechanism (116) adjusts an initial position of the second contact surface (126) relative to the first contact surface (122), thereby providing adjustable clearance between the second contact surface (126) and the first contact surface (122) for various bearing cage dimensions.

18 Claims, 4 Drawing Sheets

APPARATUS AND METHOD FOR REPAIRING A WHEEL BEARING CAGE

FIELD OF THE INVENTION

The present invention is directed to an apparatus suitable for use in repairing bearing cages (e.g., aircraft wheel bearing cages) of various dimensions and a method of repairing a bearing cage using such an apparatus.

BACKGROUND OF THE INVENTION

A typical aircraft wheel bearing includes an inner portion that may be referred to as a cone, an outer portion that may be referred to as a cup, and a bearing cage that helps secure a plurality of rollers between the cage and the cup. The cage has the approximate shape of a truncated cone with first and second circular, spaced, parallel, edges connected by a plurality of spaced ribs. The circumference of one of the edges may be smaller than the circumference of the other one of the edges so that the ribs connecting the first and second edges are angled with respect to the planes of the first and second edges. The larger edge of the bearing cage may be referred to as the outer edge of the bearing cage because it is often exposed at the side of the bearing.

It has been found these bearing cage outer edges are damaged relatively frequently when the wheel bearing is handled, for example during installation and/or maintenance. Dropping the wheel bearing from a height of even a few inches onto the exposed bearing cage can dent the bearing cage or flatten a portion of the bearing cage relative to its otherwise generally circular outer edge. Very minor damage to the bearing cage can render the wheel bearing unusable because the dented or damaged cage can rub against the rollers or otherwise interfere with wheel rotation. In addition, stresses may be concentrated at the damaged location that could cause the bearing to fail prematurely. Therefore, once damaged, entire wheel bearings are often rendered unusable. This results in discarding of an expensive wheel bearing or returning it to a manufacturer so that the bearing cage could be replaced. It has generally been thought that any damage to the bearing cage rendered the bearing cage unusable due to the misalignment that would occur between the roller and the bearing cage and due to unacceptable concentrations of stress at the location of the damage. It would be desirable, however, to provide an apparatus and a method for effectively repairing damaged bearing cages, having various dimensions, instead of discarding such damaged bearing cages.

SUMMARY OF THE INVENTION

These problems and others are addressed by embodiments of the present invention. A first aspect of the present invention directed to apparatus for repairing dented bearing cages, comprising: a first contact surface for contacting an outer diameter of the bearing cage; a second contact surface for contacting an inner diameter of the bearing cage; a first handle; a second handle operatively connected to the first handle via a pivot mechanism; a retraction element connected to the second contact surface, the retraction element retracting upon movement of the second handle relative to the first handle to move the second contact surface towards the first contact surface so as to impart a force against a dented region of the bearing cage located between the second contact surface and the first contact surface; and an adjustment mechanism for adjusting an initial position of the second contact surface relative to the first contact surface, thereby providing adjustable clearance between the second contact surface and the first contact surface for various bearing cage dimensions.

According to another aspect, the present invention is directed to a method of using the apparatus according to the first aspect of the invention to repair dented bearing cages, such a method comprising: performing calibration by placing the first contact surface against an outer diameter of the bearing cage at a non-damaged region of the bearing cage and adjusting position of the second contact surface so that the second contact surface contacts an inner diameter of said bearing cage; repositioning the first and second contact surfaces to a damaged region of the bearing cage; and moving the second handle relative to the first handle to cause the first and second contact surfaces to exert a straightening force of the damaged region.

According to another aspect, the present invention is directed to an apparatus for repairing dented bearing cages, comprising: a fixed anvil that forms a first contact surface for contacting an outer diameter of the bearing cage; a lip insert that forms a second contact surface for contacting an inner diameter of the bearing cage; a first handle; a second handle operatively connected to the first handle via a pivot mechanism; a draw bar connected to the lip insert, the draw bar retracting upon movement of the second handle relative to the first handle to pull the lip insert towards the fixed anvil so as to impart a force against a dented region of the bearing cage located between the lip insert and the fixed anvil; and an adjustment mechanism for adjusting an initial position of the lip insert relative to the fixed anvil, thereby providing adjustable clearance between the lip insert and the fixed anvil for various bearing cage dimensions.

BRIEF DESCRIPTION OF THE DRAWINGS

These aspects and features of the invention and others will be better understood after a reading of the following detailed description together with the attached drawings, in which.

DETAILED DESCRIPTION

Figure 1:
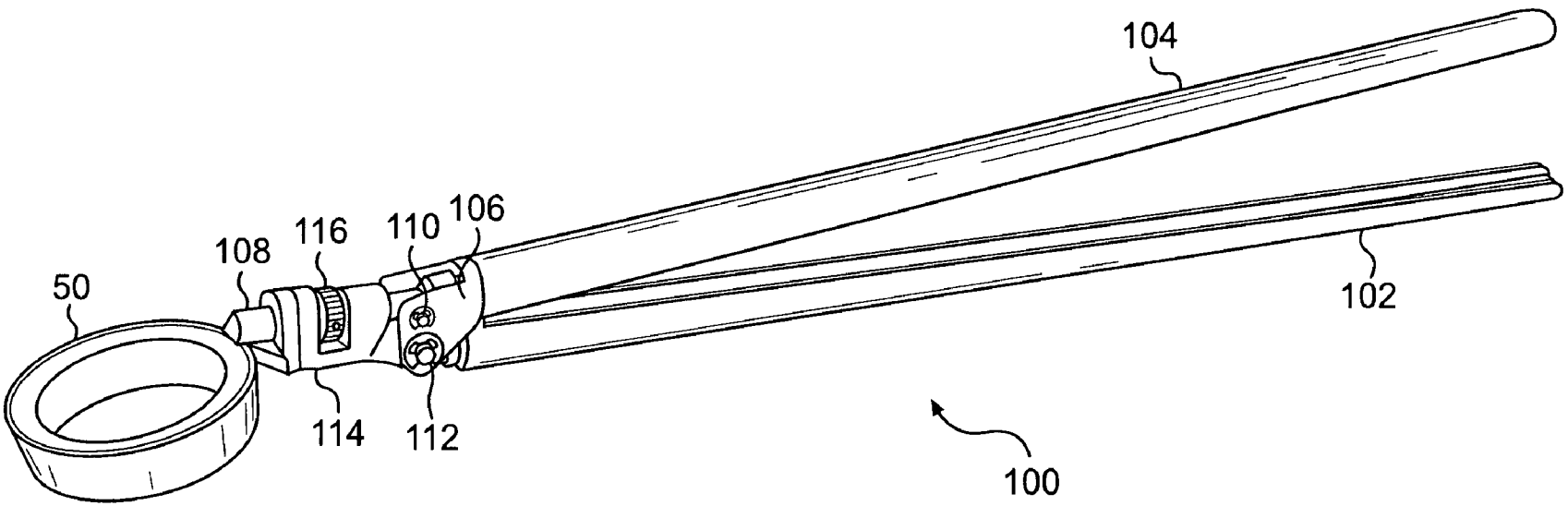
FIG. 1 illustrates an apparatus for repairing dented bearing cages according to an embodiment of the present invention.
Figure 2:
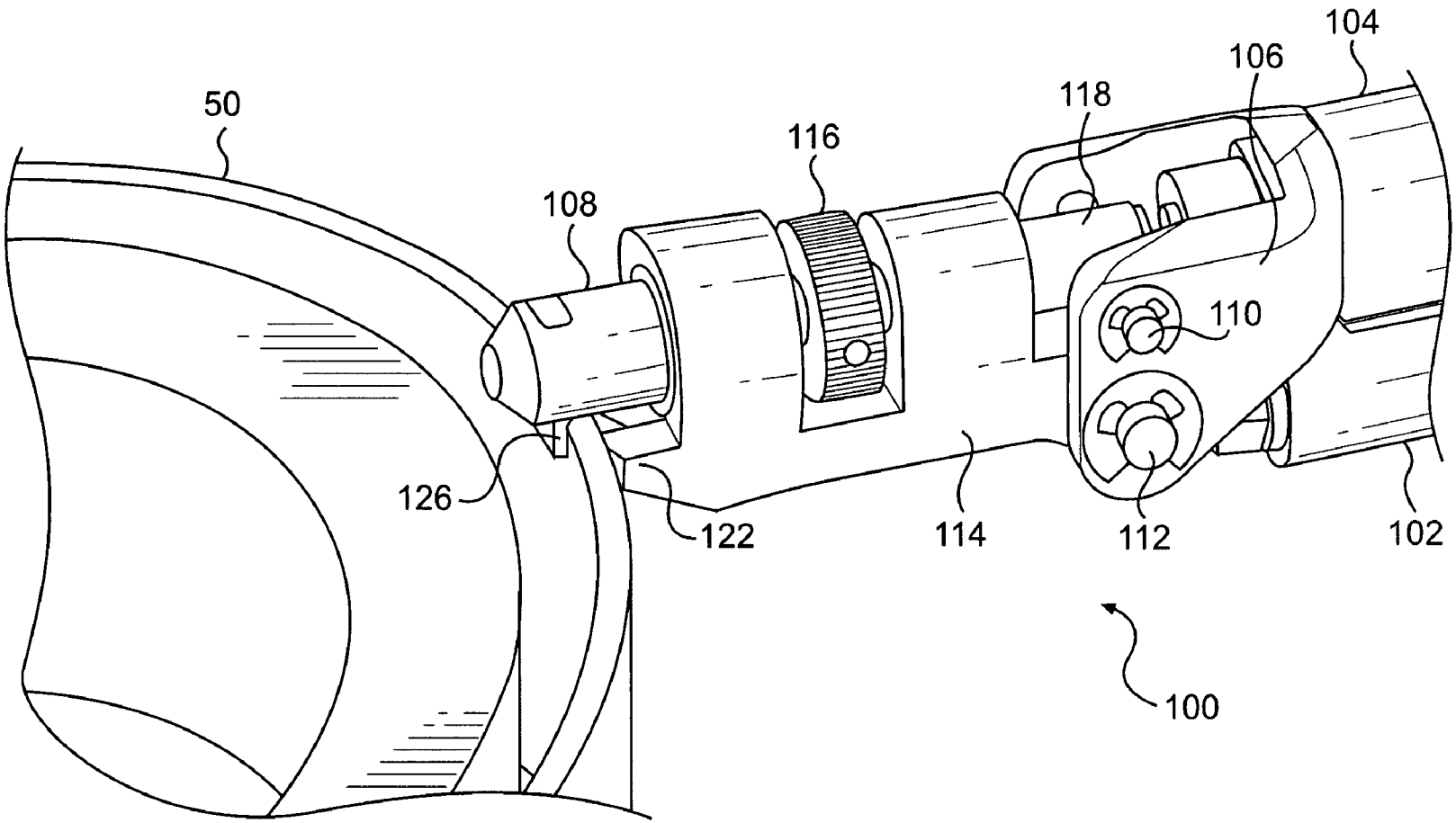
FIG. 2 illustrates, in greater detail, elements that engage with and exert force on a bearing cage for the apparatus for repairing dented bearing cages according to an embodiment of the present invention.

Referring now to the drawings, wherein the illustrations are for purposes of describing embodiments of the invention only and not for the purpose of limiting the scope of the claimed invention, FIGS. 1 and 2 illustrate an apparatus/tool 100 for repairing dented bearing cages according to an embodiment of the present invention. As shown in FIG. 1, a bearing cage repair tool 100 includes the following elements: a fixed handle 102; a moveable (forcing) handle 104; a yoke 106; a draw bar 108; and an anvil 114. The draw bar 108 extends outward through a sleeve of the anvil 114 and includes a lip insert 126 (shown in FIG. 2) that projects downward through an opening in the draw bar 108. A contact surface of the lip insert 126 is, during use, positioned proximate an inner diameter surface of the bearing cage 50. The contact surface of the lip insert 126 is separated by a clearing distance from a contact region 122 of the anvil 114, such a contact region 122 being positioned proximate an outer diameter surface of the bearing cage 50.

Figure 3:
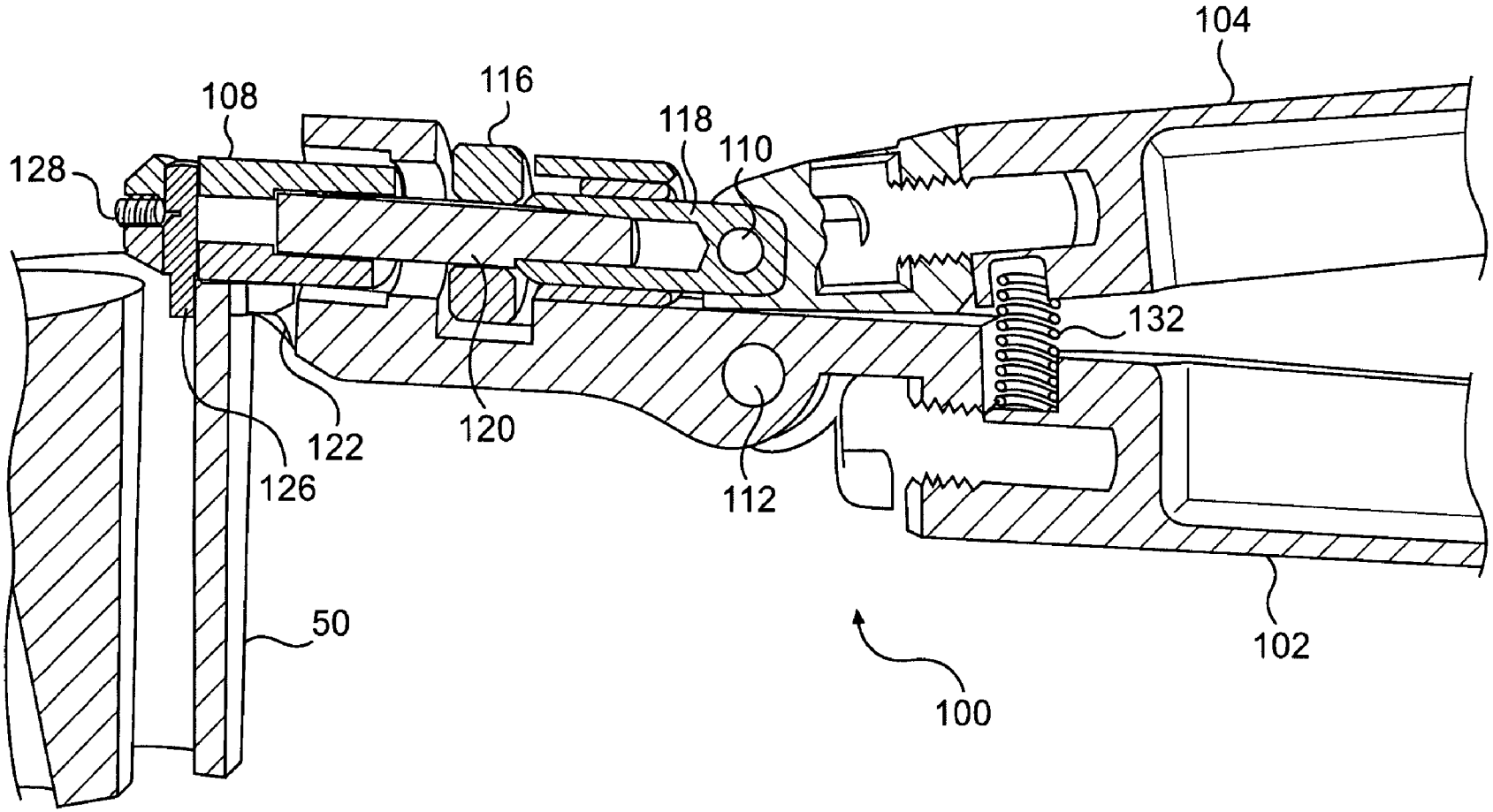
FIG. 3 is a cross-sectional illustration of the apparatus for repairing dented bearing cages according to an embodiment of the present invention.

As illustrated in FIGS. 1 and 2, the forcing handle 104 is connected to the yoke 106. This connection is further illustrated in FIG. 3, which is a cross-sectional view of the dent repair tool 100 according to an embodiment of the present invention. The yoke 106 is connected to the draw bar 108 by the following elements: a pivot pin 110, a piston 118, and a connecting bolt 120. The pivot pin 110 connects the yoke 106 to a rear portion of the piston 118. The piston 118 is connected to the draw bar 108 by the connecting bolt 120 as illustrated in FIG. 3. More specifically, in one implementation, the connecting bolt 120 is threaded for connection to the interior of the draw bar 108 and the piston 118. A thumb screw 116 is connected to the connecting bolt 120 and allows adjustment of the clearance between the lip insert 126 and the anvil contact region 122. The lip insert 126 is connected to the draw bar 108 via a locking screw 128, which is inserted through an opening on one end of draw bar 108 to exert a securing force on the lip insert 126 through an opening in the draw bar 108.

The fixed handle 102 is connected on end of the anvil 114. The yoke 106 is connected to the anvil 114 via a force reaction pin 112. In one implementation, the reaction pin 112 is fitted in a vertically-oriented, elongated slot in the anvil 114, such that the reaction pin 112 slides up and down relative to the anvil 114 as the yoke 106 rotates on pivot pin 110. As seen in FIG. 3, the fixed handle 102 and the forcing handle 104 are connected via a spring return mechanism 132. With this arrangement, downward movement of the forcing handle 104 relative to the fixed handle 102 translates into a force that retracts the draw bar 108.

The bearing cage repair tool 100 dent puller tool described above utilizes the lip insert 126 to press against an inner diameter surface of the bearing cage 50, thereby forcing a deformed bearing cage area against the contact region 122 of the fixed anvil 114 to remove the dent. The bearing cage repair tool 100 of this embodiment avoids the need for a dedicated tool for each bearing cage geometry. As described in greater detail below, clearance between the lip insert 126 and the contact region 122 is adjustable to accommodate various dimensions of the bearing cage 50.

In one exemplary implementation, the bearing cage repair tool 100 is approximately 18 inches in length and weighs approximately 16 ounces. In one exemplary implementation, stainless steel may be used as the material for components such as the anvil 114 and the yoke 106, with the lip insert 126 being made of steel and the handles 102, 104 being made of high strength aluminum alloy. This size tool is sufficient to achieve an approximate 10 lb. maximum force for straightening bearing cage dents. In one exemplary implementation, the bearing cage repair tool 100 incorporates a force multiplication force of 20 to 1, such that 10 lbs. of force on the forcing handle 104 translates into 200 lbs. of force in the lip insert 126, allowing for example the use of 10 lbs. of force at the forcing handle 104 to straighten a 0.125 inch bearing cage.

Operation of the bearing cage repair tool 100 according to an embodiment of the present invention will next be described. First, the bearing cage repair tool 100 is adjusted for geometry of the damaged bearing cage 50. With the handles 102, 104 closed, the contact region 122 of the anvil 114 is placed against the outer diameter surface of the bearing cage 50 at a non-damaged region. The thumb screw 116 is turned to move the draw bar 108 until the lip insert 126 is against the inner diameter surface of the bearing cage 50. The bearing cage repair tool 100 is now set (calibrated) for the correct geometry of the bearing cage 50 and any dent in the bearing cage 50 can now be pulled out without concern for producing a bump condition. The forcing handle 104 is then released and returned to the open state by the spring return mechanism 132.

Next, straightening of the bearing cage 50 is performed. The bearing cage repair tool 100 is repositioned to a damaged area of the bearing cage 50 and the forcing handle 104 is pulled toward the fixed handle 102, causing the yoke 106 to pivot about the pivot pin 110. The force reaction pin 112 translates rotary motion into linear motion, thereby pulling the draw bar 108 towards the anvil 114 until the draw bar adjustment 116 stops the motion against the anvil 114. The lip insert 126 forces the bearing cage 50 back to the distance defined by the initial adjustment (described above).

Figure 4:
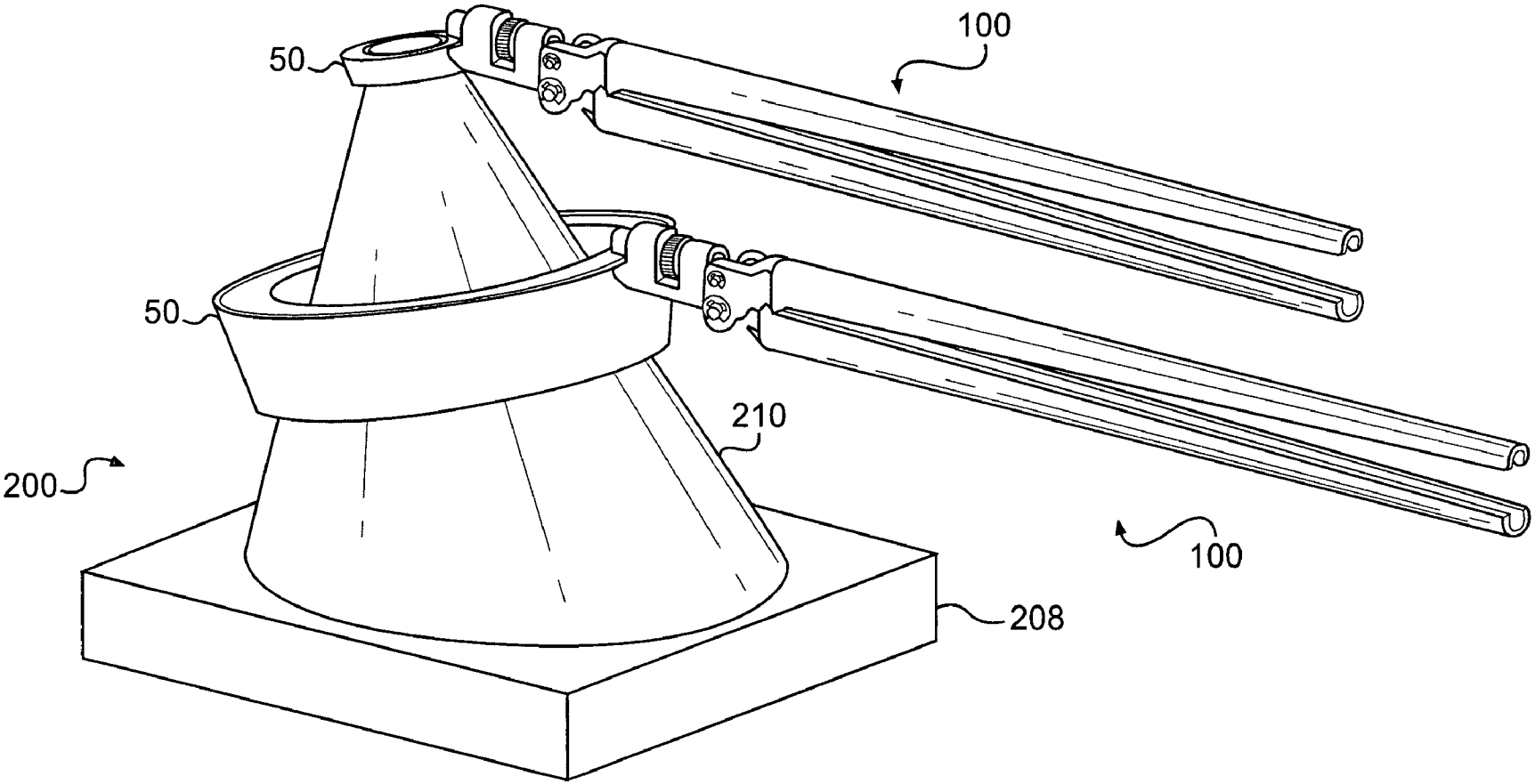
FIG. 4 illustrates use of an apparatus for repairing dented bearing cages of various dimensions according to an embodiment of the present invention.

As illustrated in FIG. 4, a bearing holding fixture 200 is used in accordance with one embodiment of the present invention to hold bearing cages 50 of various dimensions during the repair process. The bearing holding fixture 200 includes a base 208 and a cone region 210, which supports the bearing cage 50 during repair. The shape of the cone region 210 allows use for various dimensions of the bearing cage 50.

The present invention has been described herein in terms of certain preferred embodiments. Various modifications and additions to these embodiments will become apparent to those of ordinary skill in the art upon a reading of the foregoing description. It is intended that all such modifications and additions comprise a part of the present invention to the extent they fall within the scope of the several claims appended hereto.

I/We claim:

1. An apparatus for repairing dented bearing cages of generally cylindrical shape, comprising:

a first contact surface having a curved contour configured for contacting a curved outer diameter of the generally cylindrical bearing cage;

a second contact surface having a curved contour configured for contacting a curved inner diameter of the bearing cage;

a first handle;

a second handle operatively connected to said first handle via a pivot mechanism;

a retraction element connected to said second contact surface, said retraction element retracting upon movement of said second handle relative to said first handle to move said second contact surface towards said first contact surface so as to impart a force against a dented region of said bearing cage located between said second contact surface and said first contact surface; and an adjustment mechanism for adjusting an initial position of said second contact surface relative to said first contact surface, thereby providing adjustable clearance between said second contact surface and said first contact surface for various bearing cage dimensions, wherein said first contact surface and said second contact surface are configured to exert a force on said generally cylindrical bearing cage to impart a desired curve to a dented region of said bearing cage.

2. The apparatus of claim 1, wherein said denting bearing cage is an aircraft wheel bearing cage.

3. The apparatus of claim 1, wherein said adjustment mechanism includes a thumb screw connected to said retraction element.

4. The apparatus of claim 1, wherein positioning of said first contact surface is fixed.

5. The apparatus of claim 4, wherein said second contact surface is a region of an insert connected to said retraction element.

6. The apparatus of claim 1, wherein movement of said first handle toward said second handle causes said retraction element to pull said second contact surface towards said first contact surface so as to impart a force against a dented region of said bearing cage located between said second contact surface and said first contact surface.

7. The apparatus of claim 6, further comprising a spring mechanism that bias said first handle away from said second handle.

8. The apparatus of claim 6, wherein said first handle is moved so as to be substantially parallel with said second handle to repair a dent in said bearing cage.

9. The apparatus of claim 1, wherein said retraction element is a draw bar.

10. The apparatus of claim 9, further wherein said adjustment mechanism includes a thumb screw connected to said draw bar to adjust clearance between said first contact surface and said second contact surface.

11. The apparatus of claim of claim 1, further comprising a yoke, a pivot pin and a force reaction pin, where said yoke pivots about said pivot pin when the first handle is moved relative to the second handle, said force reaction pin translating rotary motion of said yoke into linear motion to move said retraction element.

12. A method for repairing dented bearing cages using an apparatus comprising:

a first contact surface for contacting an outer diameter of the bearing cage;

a second contact surface for contacting an inner diameter of the bearing cage;

a first handle;

a second handle operatively connected to said first handle via a pivot mechanism;

a retraction element connected to said second contact surface, said retraction element retracting upon movement of said second handle relative to said first handle to move said second contact surface towards said first contact surface so as to impart a force against a dented region of said bearing cage located between said second contact surface and said first contact surface; and an adjustment mechanism for adjusting an initial position of said second contact surface relative to said first contact surface, thereby providing adjustable clearance between said second contact surface and said first contact surface for various bearing cage dimensions, said method comprising:

performing calibration by placing the first contact surface against an outer diameter of said bearing cage at a non-damaged region of said bearing cage and adjusting position of said second contact surface so that the second contact surface contacts an inner diameter of said bearing cage;

repositioning said first and second contact surfaces to a damaged region of said bearing cage; and moving said second handle relative to said first handle to cause said first and second contact surfaces to exert a straightening force of said damaged region.

13. The method of claim 12, wherein said fixed handle and said second handle are closed during said step of performing calibration and then opened before said repositioning step.

14. The method of claim 12, wherein said second handle and said first handle are closed together during said moving step.

15. The method of claim 14, further comprising:

releasing said first handle and said second handle to move said second contact surface away from said first contact surface.

16. The method of claim 12, wherein said bearing cage is a generally circular bearing cage of an aircraft wheel.

17. The method of claim 12, wherein said retraction element is a draw bar and said adjustment mechanism includes a thumb screw connected to said draw bar to adjust clearance between said first contact surface and said second contact surface during said step of performing calibration.

18. An apparatus for repairing dented bearing cages of generally cylindrical shape, comprising:

a fixed anvil that forms a first contact surface having a curved contour configured for contacting an outer diameter of the generally cylindrical bearing cage;

a lip insert that forms a second contact surface having a curved contour configured for contacting an inner diameter of the generally cylindrical bearing cage;

a first handle;

a second handle operatively connected to said first handle via a pivot mechanism;

a draw bar connected to said lip insert, said draw bar retracting upon movement of said second handle relative to said first handle to pull said lip insert towards said fixed anvil so as to impart a force against a dented region of said bearing cage located between said lip insert and said fixed anvil; and an adjustment mechanism for adjusting an initial position of said lip insert relative to said fixed anvil, thereby providing adjustable clearance between said lip insert and said fixed anvil for various bearing cage dimensions, wherein said first contact surface and said second contact surface are configured to exert a force on said generally cylindrical bearing cage to impart a desired curve to a dented region of said bearing cage.

* * * * *